US005910457A

United States Patent [19]

Kolb

[11] Patent Number: 5,910,457

[45] Date of Patent: Jun. 8, 1999

[54] WOVEN BELT WEBBING FOR A VEHICLE OCCUPANT RESTRAINING SYSTEM

[75] Inventor: Andreas Kolb, Schwäbisch Gmünd, Germany

[73] Assignee: TRW Occupant Restraint Systems GmbH, Alfdorf, Germany

[21] Appl. No.: 08/737,884

[22] PCT Filed: Mar. 28, 1996

[86] PCT No.: PCT/EP96/01360

§ 371 Date: Dec. 6, 1996

§ 102(e) Date: Dec. 6, 1996

[87] PCT Pub. No.: WO96/31642

PCT Pub. Date: Oct. 10, 1996

[30] Foreign Application Priority Data

Apr. 7, 1995 [DE] Germany ..... 195 13 259

[51] Int. Cl.[6] ..... D03D 23/00

[52] U.S. Cl. ..... 442/203; 139/383 R; 139/420 R

[58] Field of Search ..... 139/383 R, 420 R; 442/203

[56] References Cited

U.S. PATENT DOCUMENTS

| | | | |
|---|---|---|---|
| 3,464,459 | 9/1969 | Ballard . | |
| 3,530,904 | 9/1970 | Ballard . | |
| 3,537,488 | 11/1970 | LeBoeuf . | |
| 3,872,895 | 3/1975 | Takada | 139/383 R |
| 4,228,829 | 10/1980 | Kikuchi | 139/408 |
| 4,662,487 | 5/1987 | Koch | 188/371 |
| 5,376,440 | 12/1994 | Koseki | 428/229 |

FOREIGN PATENT DOCUMENTS

| | | |
|---|---|---|
| 0046911 | 3/1982 | European Pat. Off. . |
| 0163778 | 12/1985 | European Pat. Off. . |
| 1910288 | 9/1969 | Germany . |
| 1946853 | 4/1970 | Germany . |
| 49-8920 | 1/1974 | Japan . |
| 50-70657 | 6/1975 | Japan . |
| 641843 | 2/1994 | Japan . |

*Primary Examiner*—Christopher Raimund

*Attorney, Agent, or Firm*—Tarolli, Sundheim, Covell, Tummino & Szabo

[57] ABSTRACT

Belt webbing designed for a vehicle occupant restraining system, which is to replace conventional force limiting means leading to added structural complexity and additional costs and which may be possibly incorrectly fitted in place, is characterized in that the warp threads (7) possess lengths differing with each length unit of the belt webbing, that is to say in the form of short warp threads (10) to bear the tensile load acting in the belt webbing (1) up to a first stretch of the belt webbing (1) without loading the longer warp threads and in the form of longer warp threads, which after the first stretch of the belt webbing (1) take part in withstanding the tensile load acting in the belt webbing (1) in a manner dependent on the ratio of the length thereof to the length of the short warp threads (10).

5 Claims, 2 Drawing Sheets

WOVEN BELT WEBBING FOR A VEHICLE OCCUPANT RESTRAINING SYSTEM

The invention relates to woven belt webbing for a vehicle occupant restraining system.

In particularly serious accidents the restraining forces of the belt webbing may be so great as to cause injuries to the vehicle occupant. For this reason vehicle occupant restraining systems are being fitted to an increasing extent with force limiting devices so designed that when a tension force as determined by the designer in the belt webbing is exceeded there is an increase in the length of the force limiting device with the conversion of energy with the result that load peaks in the restraining system may be reduced.

Such force limiting devices may for example be constituted by stretch means, which may be provided at one terminal fitting of the belt or on the belt retractor. The plastic deformation occurring when a predetermined tension load is exceeded, which leads to an increase in the length of the stretch means, may limit the belt force to a degree set by the designer. It is a disadvantage in such force limiting devices that they entail additional structural features and there is also the added danger of incorrect fitting thereof.

Limitation of force may also be achieved by using frangible elements, which are formed on the belt webbing as a sort of loop therein and which when a predetermined tension load is exceeded successively release an additional length of belt with the result that it is also possible to ensure a limitation of the tension strain to a predetermined degree. However, there is then a force limitation characteristic which may not be satisfactorily reproduced.

One object of the invention is to provide for force limitation using simple means on the belt webbing itself, whose force limiting characteristic may be readily set by the designer and is satisfactorily reproducible.

In order to achieve such aim in the context of a woven belt webbing same is characterized in that the warp threads possess lengths differing with each length unit of the belt webbing, that is to say in the form of short warp threads to bear the tensile load acting in the belt webbing up to a first stretch value of the belt webbing without loading the longer warp threads, and in the form of longer warp threads, which as from such stretch value of the belt webbing take part in withstanding the tensile load acting in the belt webbing in a manner dependent on the ratio of the length thereof to the length of the short warp threads. Such belt webbing means that there is no additional structural involvement for a force limiting device, since on exceeding a predetermined tensile load it is possible to ensure a controlled increase in length of the belt webbing by stretching of the shorter warp threads with the result that the tensile load acting in the belt webbing can be reduced to a degree determined by the designer. A further advantage of the belt webbing in accordance with the invention is that by judicious selection of the length ratios of the warp threads and the dimension thereof the characteristic of tensile load over stretch of the belt webbing may be freely selected over a wide range.

In the case of a preferred embodiment of the invention there is the provision that the longer warp threads are constituted by long warp threads of uniform length which as from the first stretch value, corresponding to the difference in length between the short and the long warp threads, of the belt webbing play a role in withstanding the tensile load acting in the same. Owing to the employment of warp threads with only two different lengths there is the advantageous compromise between cost-effective manufacturing on the one hand and sufficient possibility of variation of the characteristic: tensile load over stretch of the belt webbing on the other hand.

Further advantageous developments of the invention are defined in the dependent claims.

The preferred embodiment of the invention will now be described with reference to the accompanying drawings.

Figure 1:
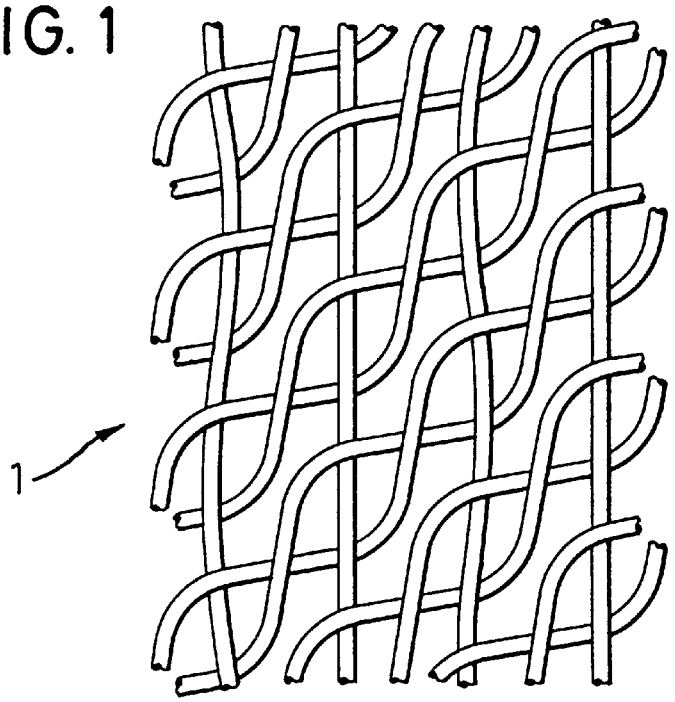
FIG. 1 shows a diagrammatic view of part of the belt webbing in accordance with the invention.
Figure 3:
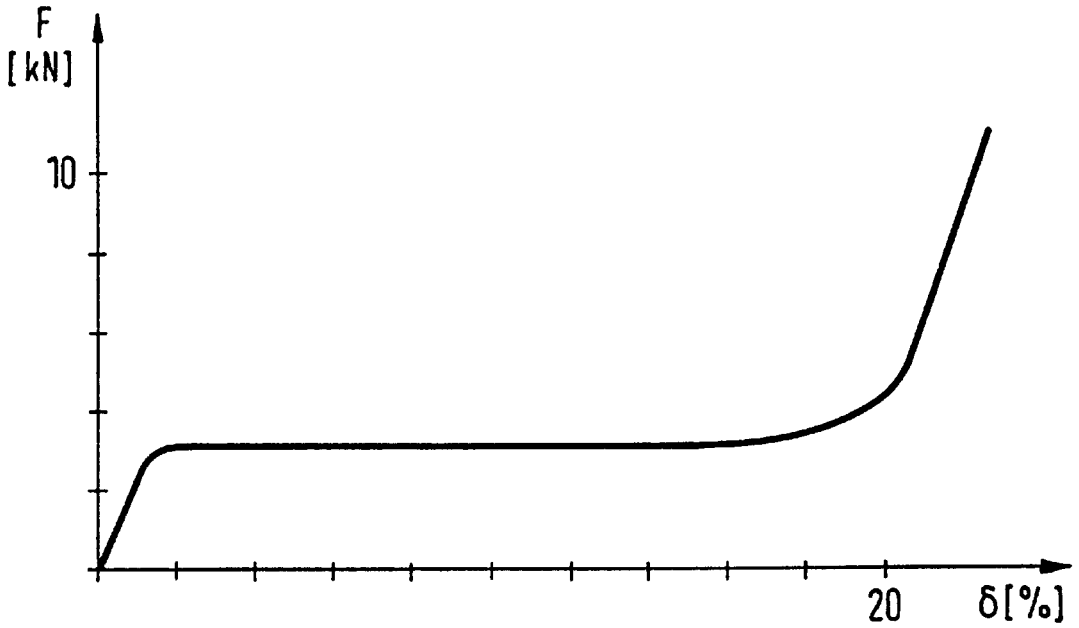
FIG. 3 shows one possible form of the curve of the characteristic: tensile load F over stretch δ for the belt webbing in accordance with FIG. 1.
Figure 2:
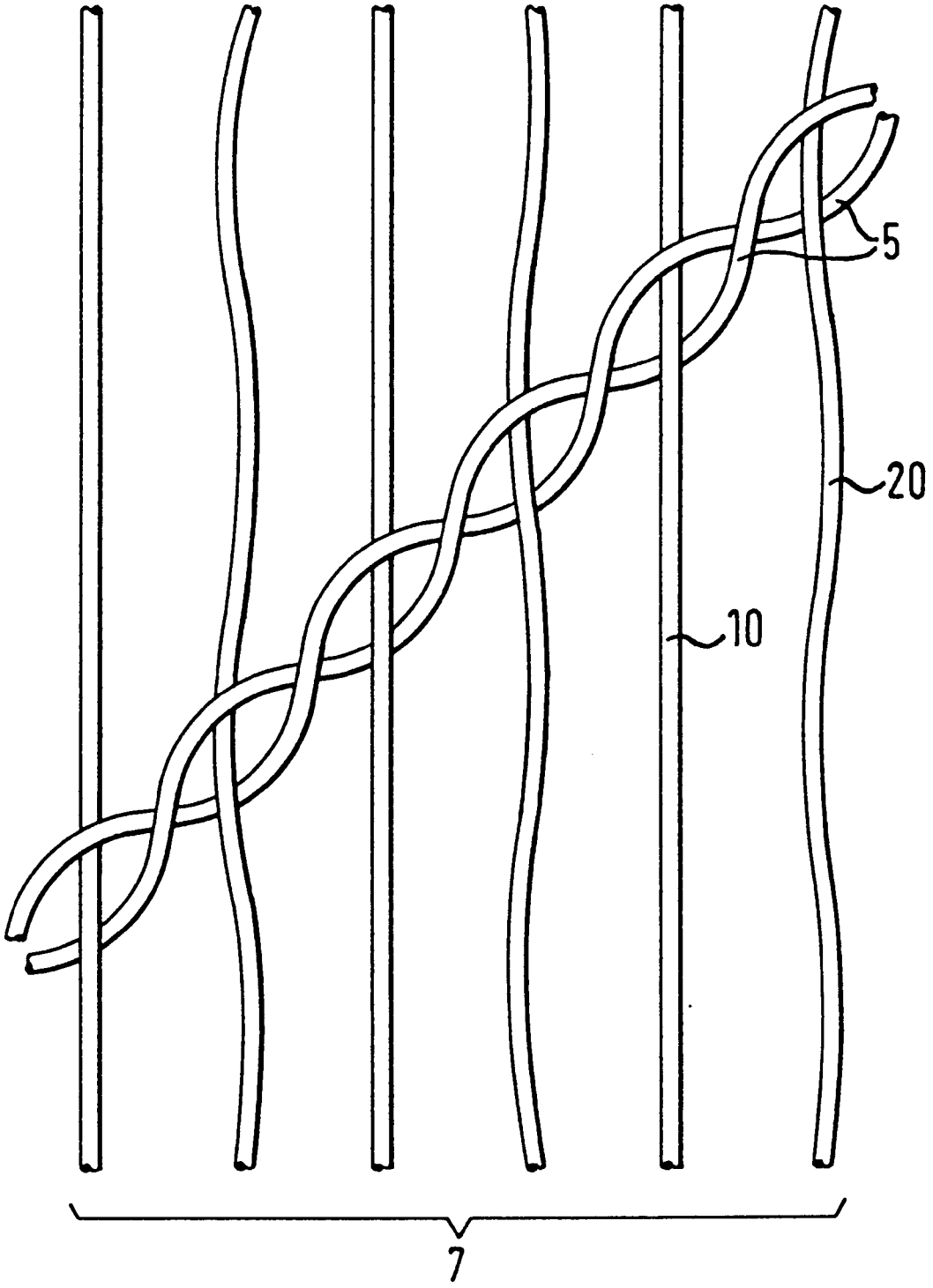
FIG. 2 shows a diagrammatic view of the warp threads of the belt webbing of FIG. 1 together with two weft threads.

In FIGS. 1 and 2 the preferred embodiment of the belt webbing 1 in accordance with the invention is represented diagrammatically. It consists of weft threads 5 woven with one another and warp threads 7 extending in the longitudinal direction of the belt webbing. As shown in FIG. 2 more particularly half of the warp threads 7 has a greater length than the other warp threads. Accordingly the warp threads 7 include short warp threads 10 and long warp threads 20. As is also more particularly indicated in FIG. 2, the short and the long warp threads 10 and 20 are arranged alternatively. It has been found to be a particular advantage if the long warp threads 20 are longer by approximately 20% per length unit of the belt webbing 1 than the short warp threads 10. Limitation of force of the belt webbing 1 in accordance with the invention is performed in a vehicle crash as follows (see also FIG. 3): in the case of normal use of the belt webbing 1 the tensile load acting therein is exclusively borne by the short warp threads 10. In this case there is substantially no stretch of the belt webbing 1. It is only as from reaching a first limiting force, which in the case of the curve as shown in FIG. 3 amounts to approximately 3 kN, that there is substantial stretch of the belt webbing 1. Since the weft threads 5 and the warp threads 7 consist of polyethylene, on reaching this first limiting force there will be a substantial stretch of the belt webbing 1 up to a first stretch value of approximately 20%, such stretch of the belt webbing 1 taking place at a substantially constant tensile load on the belt webbing 1. Up till the attainment of this first stretch value, the tensile load effective in the belt webbing 1 will further be exclusively borne by the short warp threads 10.

As from this first stretch of the belt webbing 1, which corresponds to the difference in length between the short warp threads 10 and the long warp threads 20, the long warp threads 20 will take part in bearing the tensile load F acting in the belt webbing 1, something which leads to a limitation of stretch of the short warp threads 10. Accordingly the curve: tensile load F over stretch δ will be so changed that an increase in stretch δ will be accompanied by an increase in tensile load F. Consequently it is possible to ensure that even after reaching the first stretch value the belt webbing 1 will possess sufficient strength, if there should now be an even greater tensile load to be borne. For the employment of the belt webbing 1 in accordance with the invention as a force limiting means in a vehicle occupant restraining system the design parameters of the belt webbing 1 are so selected that the first limiting force, at which stretch of the belt webbing 1 takes place up to the first stretch value, will correspond to the force above which injury of the vehicle occupant is likely and above which the force limiting function should commence.

I claim:

1. A woven belt webbing for a vehicle occupant restraining system, said belt webbing comprising:

weft threads and warp threads forming a weave, said warp threads consisting of a first type having, when extended, a first length, and of a second type having, when extended, a second length, said second length being approximately 20% longer than said first length so that an initial tensile load acting on said belt webbing and not exceeding a predetermined threshold level is taken up exclusively by stretching of said warp threads of said first type, said warp threads of said first type further stretching to take up additional tensile load in excess of said predetermined threshold level and being assisted in taking up said additional tensile load by stretching of said warp threads of said second type.

2. The belt webbing of claim 1 wherein said warp threads of said first type and said warp threads of said second type are utilized in at least approximately equal numbers.

3. The belt webbing of claim 1 wherein said weft threads and said warp threads consist of polyethylene.

4. The belt webbing of claim 1 wherein said first and second types of said warp threads are made of a single material.

5. The belt webbing of claim 1 wherein each of said warp threads in said weave weaves over top of a first one of said weft threads and underneath of each weft thread adjacent to said first weft thread.

* * * * *